US011272770B2

(12) United States Patent
Maddox et al.

(10) Patent No.: US 11,272,770 B2
(45) Date of Patent: Mar. 15, 2022

(54) WEARABLE REMOTE SPEAKER MIC HOLDER, RADIO SUPPORT, AND SYSTEM COMPRISING THE SAME

(71) Applicant: BreakThrough Innovations, LLC, Bellbrook, OH (US)

(72) Inventors: Doug Maddox, Waynesville, OH (US); Trent Brian Shroyer, Bellbrook, OH (US); Nicholas Robert Seitz, Miamisburg, OH (US)

(73) Assignee: BreakThrough Innovations, LLC, Bellbrook, OH (US)

( * ) Notice: Subject to any disclaimer, the term of this patent is extended or adjusted under 35 U.S.C. 154(b) by 39 days.

(21) Appl. No.: 16/811,642

(22) Filed: Mar. 6, 2020

(65) Prior Publication Data

US 2020/0205534 A1 Jul. 2, 2020

Related U.S. Application Data

(62) Division of application No. 15/927,555, filed on Mar. 21, 2018, now Pat. No. 10,595,603, which is a (Continued)

(51) Int. Cl.
*A45F 5/00* (2006.01)
*A45C 11/00* (2006.01)
(Continued)

(52) U.S. Cl.
CPC ..... *A45C 11/00* (2013.01); *A45F 3/14* (2013.01); *A45F 5/00* (2013.01);
(Continued)

(58) Field of Classification Search
CPC ..... A45F 3/14; A45F 3/02; A45F 5/00; A45F 5/02; A45F 5/021; A45F 2003/025;
(Continued)

(56) References Cited

U.S. PATENT DOCUMENTS 3,868,573 A 2/1975 Holcomb et al.
4,204,657 A * 5/1980 Graham ..... B64D 11/0647 244/122 R (Continued)

FOREIGN PATENT DOCUMENTS

WO 2001024656 A1 4/2001

OTHER PUBLICATIONS

ITW Nexus Advanced Website (http://www.itwnexusadvanced.com/content/web-dominator), last visited on Jan. 21, 2014 via the Internet Archive Wayback Machine (Year: 2014).*

(Continued)

*Primary Examiner* — Scott T McNurlen
(74) *Attorney, Agent, or Firm* — FisherBroyles, LLP; Susan M. Oiler

(57) ABSTRACT

A wearable radio support system has a shoulder strap connectable to a radio holder and an elongate strap extending therefrom. The shoulder strap has a shoulder-contact portion that includes a first set and a second set of attachment features. The elongate strap has a first end with a first fastener and a second fastener that are releasably attachable to either of the first set or the second set of attachment features of the shoulder strap. The first fastener connects to a first feature of either of the first or second set of attachment features and provides a point of rotation for the elongate strap relative to the shoulder strap and the second fastener connects to a second feature of the same set of attachment features to anchor the elongate strap to the shoulder strap, thereby the first end of the elongate strap no longer rotates about the first feature.

16 Claims, 10 Drawing Sheets

Related U.S. Application Data division of application No. 14/857,904, filed on Sep. 18, 2015, now Pat. No. 9,955,761.

(60) Provisional application No. 62/052,936, filed on Sep. 19, 2014.

(51) Int. Cl.
*A45F 3/14* (2006.01)
*A45F 5/02* (2006.01)

(52) U.S. Cl.
CPC ..... *A45C 2011/002* (2013.01); *A45F 5/02* (2013.01); *A45F 5/021* (2013.01); *A45F 2003/142* (2013.01); *A45F 2005/006* (2013.01); *A45F 2200/0516* (2013.01)

(58) Field of Classification Search
CPC ..... A45F 2003/007; A45F 2003/142; A45F 2003/146; A45F 2003/148; A45F 2005/006; A45F 2200/0516; A45C 2011/002; H04B 2001/3855; H04B 2001/3872
USPC ..... 224/257, 603–605, 660, 677–678, 224/578–579, 639, 647
See application file for complete search history.

(56) References Cited

U.S. PATENT DOCUMENTS

| | | | | |
|---|---|---|---|---|
| 4,729,591 | A * | 3/1988 | Scalise | A63C 11/025 224/578 |
| 5,121,865 | A | 6/1992 | Howard | |
| 5,440,761 | A | 8/1995 | Abrams et al. | |
| 5,850,613 | A | 12/1998 | Bullecks | |
| 5,915,609 | A | 6/1999 | Diakoulas | |
| 6,179,666 | B1 | 1/2001 | Osborn | |
| 6,375,056 | B1 | 4/2002 | Henri | |
| 7,090,102 | B1 | 8/2006 | Lipke | |
| 8,209,785 | B2 | 7/2012 | Underwood et al. | |
| 2002/0130150 | A1 | 9/2002 | Stanley | |
| 2003/0102342 | A1 | 6/2003 | Fogg | |
| 2008/0006668 | A1 | 1/2008 | Nowacki et al. | |
| 2008/0203127 | A1* | 8/2008 | Castillo-Garrison | A45F 5/02 224/607 |
| 2008/0210729 | A1 | 9/2008 | Pittman et al. | |
| 2008/0296327 | A1 | 12/2008 | Murdoch et al. | |
| 2009/0000083 | A1 | 1/2009 | Richard et al. | |
| 2009/0127308 | A1 | 5/2009 | Mori et al. | |
| 2010/0163591 | A1 | 7/2010 | Stutz et al. | |
| 2011/0126338 | A1 | 6/2011 | Steinbeck | |
| 2014/0131411 | A1* | 5/2014 | McBride | A45F 3/14 224/600 |
| 2014/0310857 | A1 | 10/2014 | Lastik et al. | |
| 2014/0338157 | A1 | 11/2014 | Iannello et al. | |

OTHER PUBLICATIONS

Product information featuring "Boston Leather" by FireStoreOnline, www.firestoreonline.com/boston-leather-fire-radio-holder-gold-combo-set.aspx (retrieved from the internet on Jul. 14, 2014).
"MOLLE" Wikipedia, http://en.wikipedia.org/wiki/MOLLE (retrieved from the internet on Sep. 8, 2014).
Webpage featuring "Product Review: Leather Radio Strap, Holder, & Anti-Sway Strap," by Firegeezer, http://www.firegeezer.com/2013/06/03/product-review-leather-radio-strap-holder-anti-sway (retrieved from the internet on Sep. 8, 2014).
Webpage featuring "Portable Radio Placement in the IDLH, Fairfax County Fire & Rescue Department, Communications Section," http://www.osfc.pa.gov/Documents/Portable%20Radio%20Placement%20IDLH.pdf (Jan. 2013).
ITW Nexus Advanced Website (http://itwnexusadvanced.com/content/web-dominator) last visited on Jan. 21, 2014 via the internet Archive Wayback Machine.
Soldierststems.net, Release of AustriAlpin D-Ring COBRA Buckle, posted on Sep. 18, 2013.
U.S. Non Final Office Action; U.S. Appl. No. 14/857,904 Notification dated Mar. 10, 2017 (12 pages).
U.S. Final Office Action; U.S. Appl. No. 14/857,904 Notification dated Aug. 29, 2017 (9 pages).
U.S. Notice of Allowance; U.S. Appl. No. 14/857,904 dated Dec. 21, 2017 (7 pages).
U.S. Non Final Office Action; U.S. Appl. No. 15/927,555 Notification dated Apr. 18, 2019 (10 pages).
U.S. Final Office Action; U.S. Appl. No. 15/927,555 Notification dated Aug. 20, 2019 (7 pages).
U.S. Notice of Allowance; U.S. Appl. No. 15/927,555 dated Nov. 13, 2019 (6 pages).

* cited by examiner

WEARABLE REMOTE SPEAKER MIC HOLDER, RADIO SUPPORT, AND SYSTEM COMPRISING THE SAME

RELATED APPLICATIONS

This application is a divisional application of U.S. application Ser. No. 15/927,555, filed Mar. 21, 2018, which is a divisional application of U.S. Pat. No. 9,955,761, issued May 1, 2018, which claims the benefit of U.S. Provisional Application No. 62/052,936, filed Sep. 19, 2014, which is incorporated herein by reference.

TECHNICAL FIELD

The present patent application relates to wearable strap devices and systems for accommodating the storage of objects, and, more particularly, to a wearable strap device for supporting portable radio equipment and optionally accessories thereto.

BACKGROUND

Firefighters and other first responders, such as Emergency Medical Services ("EMS") personnel and police officers, frequently carry portable radio equipment to facilitate real-time communication with other members of a response team at the scene of an emergency situation. This radio equipment includes the radio unit itself, which can weigh 1-2 pounds or more, as well as a remote speaker microphone ("RSM") attached to the radio unit via a cord, which is positioned proximate to the lapel of the wearer. Firefighters often carry other equipment, such as flashlights, knives, backup radios, and other tools required in emergency scenarios. Accordingly, the firefighter must wear clothing or other gear that strikes a delicate balance between providing safe storage of the radio and other equipment when not in use and providing quick and easy access to the stored items when required. Firefighters are often exposed to extreme temperatures and that they must frequently crawl and/or squeeze through tight spaces during an emergency situation. Accordingly, a wearable storage system must include protections against melting/heat damage to both the stored items and the storage system itself, as well as protections against entanglement with objects in the emergency environment.

This challenge is compounded in the case of radio equipment because the power of the signal from the radio unit diminishes significantly when the antenna is obstructed. The radios typically used by firefighters generally function best when there is a direct line of sight between the user's radio and the antenna of the system with which the user's radio communicates. Accordingly, optimal signal is achieved when the radio is exposed. For example, the radio may function well when it is extended below the bottom of a firefighter's coat, with the antenna angled away from the wearer's body.

Existing wearable storage solutions of radio equipment include pockets directly incorporated into the firefighter's clothing to hold the equipment and shoulder straps (generally made of leather) designed to position the radio equipment near the wearer's hip and, in some cases, include a leash mechanism attached to the belt or pants (prone to snagging or entanglement) to keep the radio generally in place. Each of these conventional means poses a number of drawbacks and risks which may detract from the functionality of the radio equipment, and/or increase the risk of harm to the equipment and/or the firefighter himself. For example, storage of the radio in a pocket both significantly weakens the power of the signal and also increases the risk of equipment loss from the radio falling out of the pocket—especially if the wearer is crawling. In the case of conventional shoulder straps, the sheer weight of the radio may strain the wearer's neck and/or shoulders after use for a period of time, causing discomfort and pain. Further, the conventional shoulder strap is often inconvenient, because when the firefighter is preparing to respond to an emergency, the shoulder strap must generally be taken off to don personal protective equipment ("PPE") such as turnout gear, and then put back on over the PPE, which increases the response time to the emergency situation. The anti-sway leash can also be unwieldy and interfere with PPE, and it does nothing to relieve the weight burden on the wearer's neck and/or shoulder. In both the pocket and shoulder strap scenarios, the RSM and/or the cord thereto is also exposed to a significant risk of being melted, damaged, and/or entangled with the environment because they are often positioned almost entirely outside of the protection of the PPE.

Accordingly, those skilled in the art continue to seek improved devices for safely and effectively storing wearable items such as radio equipment, without detracting from the functionality of the items in the field.

SUMMARY

In one aspect, wearable radio supports having a radio mount portion and a belt attachment strap are disclosed. The radio mount portion includes an attachment scaffold with a first end receivable through a loop on a radio or radio holder and foldable upon a secondary section of the attachment scaffold to enclose the loop, a spacing extension member extending from the attachment scaffold thereby spacing the attachment scaffold a preselected distance from the belt, and a first fastener coupled to the spacing extension member at an end opposite the attachment scaffold. The radio mount portion may also include a first arm and a second arm extending from one or both of the attachment scaffold and the spacing extension on opposing sides thereof. The first and second arms each include a fastening member at a free end thereof. The belt attachment strap has a first end and a second end, a sleeve defining a channel therethrough adapted to receive a belt of a user, and a second fastener coupled to the first end of the belt attachment strap. The second fastener is rotatable about the first end and is releasably attachable to the first fastener of the radio mount portion.

In all aspects, the first fastener and the second fastener, in a mated configuration, have a load bearing capacity of at least 500 pounds and may form are a quick-release buckle.

In one embodiment, the attachment scaffold comprises patches of hook-and-look material positioned for mating engagement where the first end is foldable upon the secondary section of the attachment scaffold.

In another aspect, wearable radio support systems are disclosed that include the wearable radio support disclosed herein that include the first arm and the second arm extending from one or both of the attachment scaffold and the spacing extension, and includes a shoulder strap having a first radio support connector releasably attached to the fastening member of first arm of the radio support and a second radio support connector releasably attached to the fastening member of the second arm of the radio support. The wearable radio support system optionally includes an elongate strap having a first end releasably attachable or permanently attached to the shoulder strap, having an opposing free end, and having one or more of a strip of Molle loops, hook-and-loop material, and a mic strap retainer member releasably securing a wire of a RSM to the elongate strap along the length of a first major side of the elongate strap. The opposing free end further comprises a second releasably attachable fastener.

In all aspects, the first end of the elongate strap has a first releasably attachable fastener. The first releasably attachable fastener is a one-way snap.

In some embodiments, the second releasably attachable fastener includes an open portion that is slidable through a Molle loop.

In all aspects, the connection of the first end of the elongate strap to the shoulder strap provides a point of rotation for the elongate strap relative to the shoulder strap. The elongate strap is rotatable from a first position of overlayment along the shoulder strap to a plurality of positions upward away from the shoulder strap in its donned position.

In some embodiments, the elongate strap also has a third releasably attachable fastener, proximate the second releasably attachable fastener. The third releasably attachable fastener is releasably attachable to a feature of a donnable turnout coat.

In all aspects, the elongate strap is made of fire and abrasion resistant material or includes a flap of fire and abrasion resistant material foldable over the elongate strap and releasably attachable thereto.

DETAILED DESCRIPTION

Figure 1:
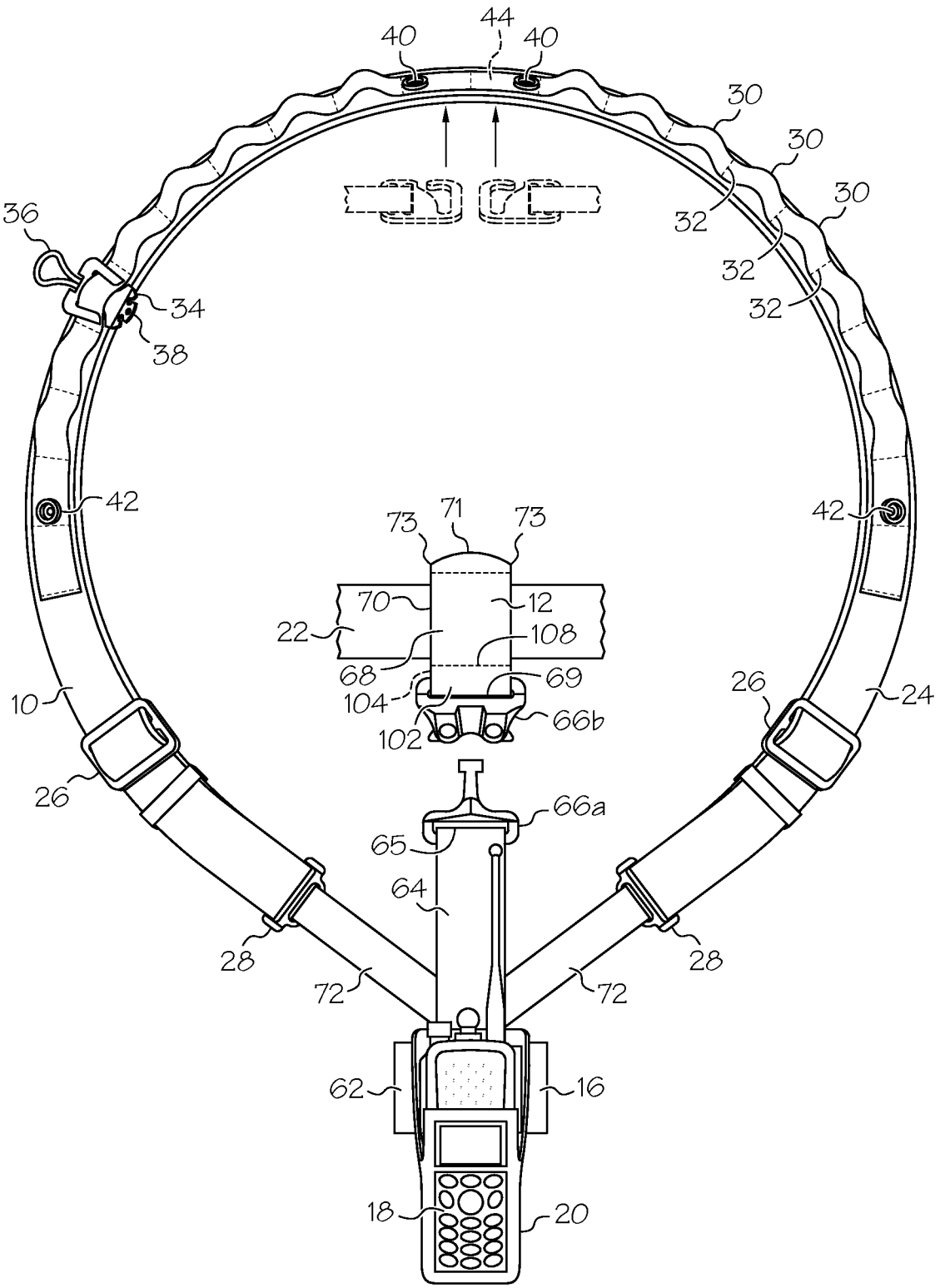
FIG. 1 is a plan view of an embodiment of a wearable radio support system.

The following detailed description will illustrate the general principles of the invention, examples of which are additionally illustrated in the accompanying drawings. In the drawings, like reference numbers indicate identical or functionally similar elements.

Figure 2:
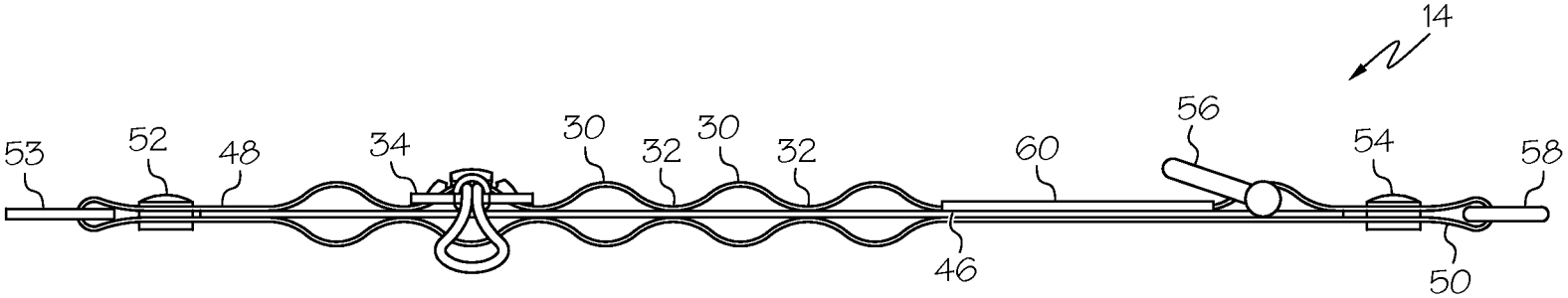
FIG. 2 is a side view of an embodiment of a remote speaker mic holder.
Figure 3:
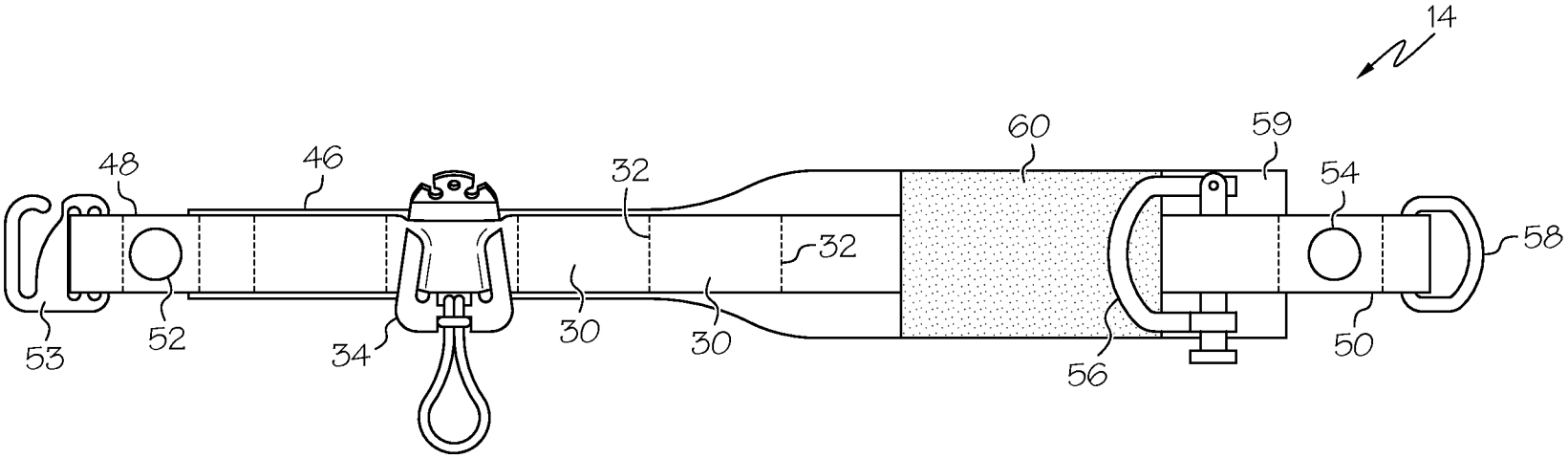
FIG. 3 is a top view of the remote speaker mic holder of FIG. 2.

Referring to FIGS. 1-3, a wearable radio support system is disclosed. The support system includes a shoulder strap 10 (FIG. 1) typically worn like a sash, a belt attachment strap 12 (FIG. 1) coupled by a releasably fastener to a radio mount 16 and a remote speaker mic holder 14 (FIGS. 2, 3). The shoulder strap 10 attaches to a radio mount 16, which is adapted to secure and support a radio 18 and/or a radio holder 20. The radio mount 16 is releasably attachable to the belt attachment strap 12 and is adapted to attach to the belt 22 of a user. The remote speaker mic holder 14 is adapted to secure and support a microphone 23 (FIGS. 8, 10-12). The remote speaker mic holder 14 releasably attaches to the shoulder strap 10. In use, the disclosed system ensures that (1) the radio 18 is well-positioned to extend below the bottom of the user's coat with the antenna canted away from the user's body, thereby enabling quality signal transmission; (2) the microphone 23 is well-supported and positioned near the lapel of the user for convenient access; and (3) the system is nearly entirely protectable by the wearer's PPE, all while simultaneously providing improved weight distribution to minimize user discomfort.

Referring to FIG. 1, in one embodiment, the shoulder strap 10 includes a body 24 constructed of a length of flexible material formed into a loop. Any of a variety of materials can be used, but in one embodiment, a military-grade, nylon webbing, or those materials used for SCBA webbing having Kevlar® material, PBI® material, and/or Nomex® material therein, may be used to provide enhanced strength and durability, including resistance to high temperatures. In another embodiment, leather may be used. The body 24 may be formed of a single segment of material, or it may alternately be assembled by a plurality of segments of material permanently or releasably coupled together. The body 24 may include one or more slides 26 and loop 28 structures to facilitate adjustment of the length of the body 24 as appropriate to size the shoulder strap 10 to fit the user. The body 24 includes a plurality of attachment features 40, 42 to facilitate attachment of the remote speaker mic holder 14 (as discussed in more detail, below). The body 24 may be permanently attached to the radio mount 16, or, alternately, the body 24 and the radio mount 16 may be releasably attached to each other by any of a variety of attachment systems known in the art, including but not limited to buckles, clips, snaps, hook-and-loop fasteners, and the like.

The body 24 of the shoulder strap 10 may include a modular lightweight load-carrying equipment (MOLLE) system/pouch attachment ladder system (PALS) to facilitate attachment of modular additions or accessories to be carried by the user, such as flashlights, knives, additional radios, and the like. The MOLLE system is formed by a plurality of loops 30 defined by lengths of material having no longitudinal stitching disposed between a plurality of transverse stitches 32 along the body 24 of the shoulder strap 10 (see FIGS. 2 and 3, which depict an analogous MOLLE system in the context of the remote speaker mic holder 14). The MOLLE system may be included on one or both sides of the body 24. To secure a component to the shoulder strap 10 via the MOLLE system, one or more buckles or hooks on the component are attached to one or more of the loops 30 of the MOLLE system. In the depicted embodiment, a cord retention clip 34 is attached through one of the loops 30 for the purpose of securing the cord (not shown) that connects the microphone 23 to the radio 18. In one embodiment, the cord retention clip 34 includes an elastic loop 36 and an anchor 38. To use the clip 34, the cord is positioned against the strap, and the elastic loop 36 is stretched over the cord and secured to the anchor 38, thereby locking the cord in place.

Figure 10:
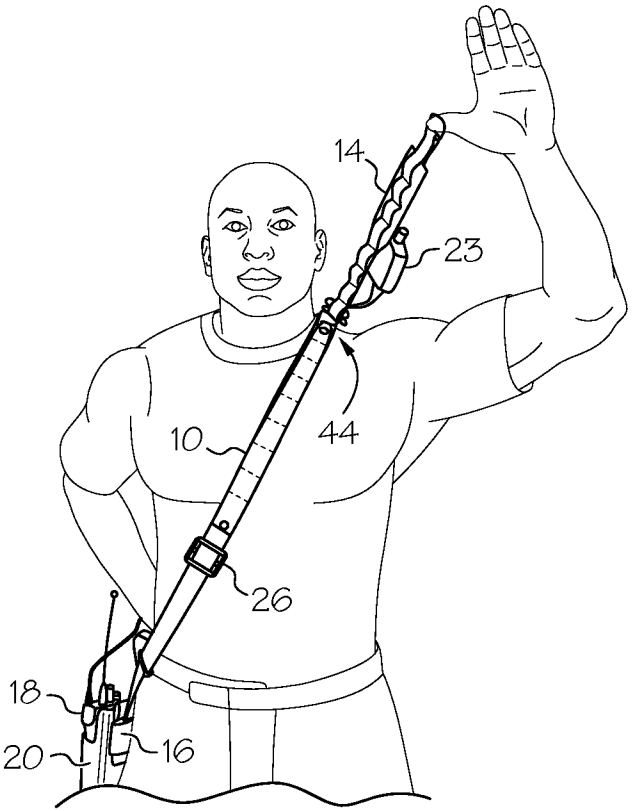
FIG. 10 is a front perspective view of the user of FIG. 9 extending remote speaker mic holder of the wearable radio support system.
Figure 9:
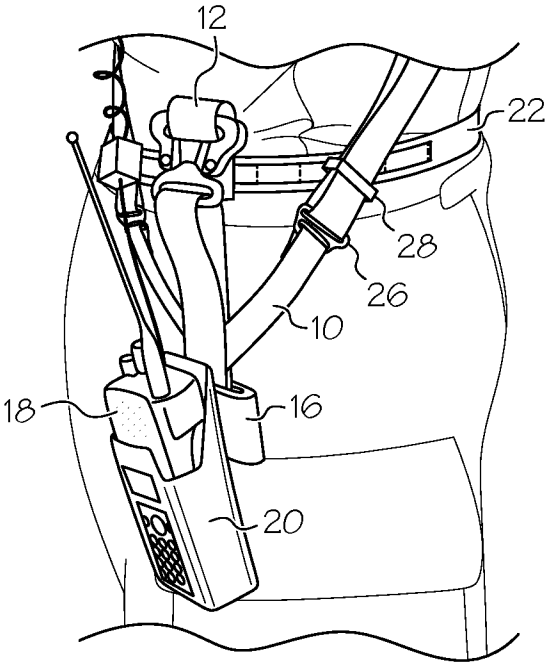
FIG. 9 is an enlarged view side perspective view of the user and the radio mount of the wearable radio support system of FIG. 9.
Figure 8:
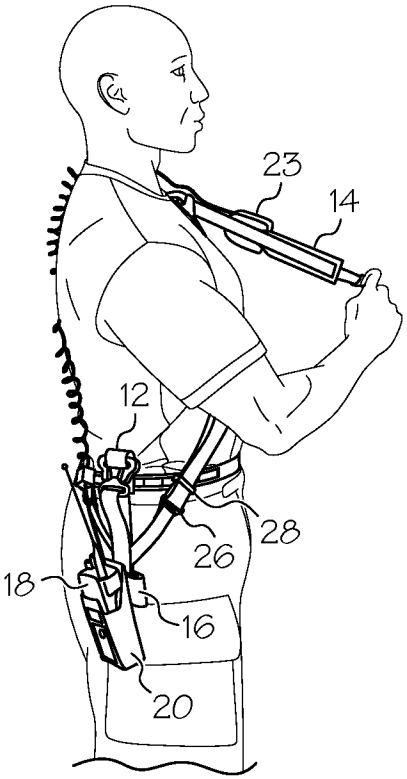
FIG. 8 is a side perspective view of a user wearing a wearable radio support strap system in accordance with one embodiment.
Figure 12:
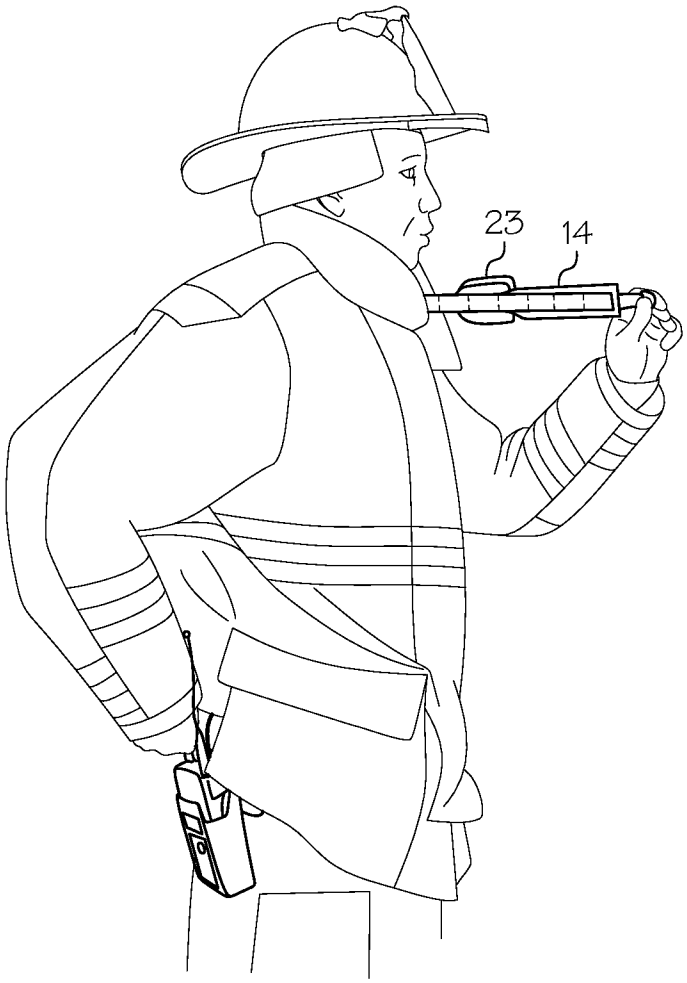
FIG. 12 is a side perspective view of the user of FIG. 9 accessing the remote speaker mic holder and accessing a radio supported in the wearable radio support system while wearing turnout gear.

As shown in FIGS. 8-10, a user may don the shoulder strap 10 by looping the strap 10 about the torso with a shoulder-contact portion 44 of the shoulder strap 10 resting on the shoulder near the neck. The radio mount 16 may be positioned near the hip on the opposite side of the user's body. To increase comfort for the wearer, the shoulder-contact portion 44 may be lined with a suitable soft material. The shoulder strap 10 may be worn under the user's PPE, such as the coat of the user's turnout gear, with the radio mount 16 extending at least partially below the coat such that the antenna of the radio 18 is exposed (FIG. 12).

Referring now to FIGS. 2 and 3, in one embodiment, the remote speaker mic holder 14 includes an elongate body 46 constructed of a length of material, typically a generally flexible material. Any of a variety of materials can be used, but in one embodiment, a military-grade, nylon webbing may be used to provide enhanced strength and durability. The elongate body 46 of the remote speaker mic holder 14 may be constructed of the same or different materials as the body 24 of the shoulder strap 10. In one embodiment, the elongate body 46 is at least about six inches long, and in another the body is about two feet long or less. More particularly, the elongate body 46 may be from about one foot to two feet long, or still more particularly about sixteen inches long. The length of the remote speaker mic holder 14 may be adjustable. The remote speaker mic holder 14 may be further equipped with a sleeve or sheath (not shown) constructed of a fireproof or fire-resistant material suitable for use by firefighters that fits over the exterior thereof to provide further protection from heat and flames to the harness 14, the microphone cord, and/or other components attached thereto.

Figure 11:
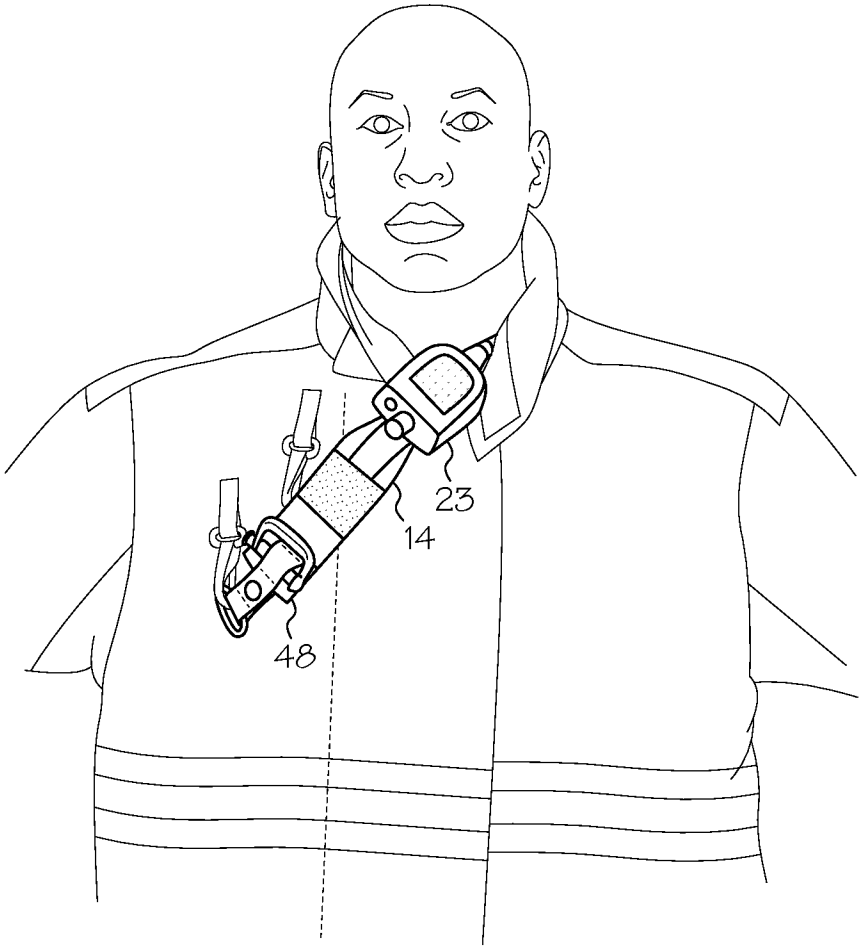
FIG. 11 is a front perspective view of the user of FIG. 9 wearing the shoulder strap of the wearable radio support system beneath turnout gear with the remote speaker mic holder extended outside of and attached to the turnout gear.

The elongate body 46 may include a MOLLE system including a plurality of loops 30 defined between stitches 32. The microphone 23 as shown in FIGS. 10-12 may be adapted to mount to the remote speaker mic holder 14 via the loops 30 of the MOLLE system (for example, as shown in FIGS. 10 and 11), and one or more cord retention clips 34 may be used to secure the cord (not shown) to the microphone 23 against the elongate body 46 of the remote speaker mic holder 14. Latched hooks 56, loops 58, and other attachment devices may be positioned along the elongate body 46 to provide options to the user for securing items to the remote speaker mic holder 14, or alternatively for securing the remote speaker mic holder 14 to other pieces of equipment, such as the user's turnout gear (FIG. 11). The MOLLE system may be included on both sides of the elongate body 46, as shown in FIG. 2.

The elongate body 46 may include a segment of hook-and-loop material 60 to facilitate attachment of tags, morale patches, or other insignia as desired by the user.

Referring to FIGS. 1-3, the remote speaker mic holder 14 has an elongate body 46 having a first end 48 and a second end 50 and a first major side 59. The first end 48 may be adapted to releasably attach to the shoulder strap 10. The second end 50 includes a first attachment member 54 or 56, or 58 positioned at or proximate thereto and are connectable to a feature of the donnable article of clothing (such as feature 218 in FIG. 16) and/or the donnable gear (such as attachment feature 42 on the shoulder strap 10 of FIG. 1) to anchor the second end 50 of the RSM holder 14 in a desired position to locate the RSM proximate the mouth of the wearer.

The first end 48 of the elongate body 46 includes a second attachment member 53 releasably attachable to the donnable gear or an article of clothing. The second attachment member 53 provides a point of rotation for the elongate body 46 relative to the donnable gear or article of clothing. The elongate body 46 is rotatable from a first position of overlayment along the donnable gear or article of clothing to a plurality of positions up to at least 45 degrees relative to the donnable gear or article of clothing in its donned position. FIGS. 8 and 10 illustrate the elongate body 46 in two different positions relative to the first position of overlayment, which would be along the strap 10 against the chest in FIG. 10. As shown in FIG. 10, the elongate body 46 is rotatable to a plurality of position between the first position of overlayment up to a final position of at least 180 degrees relative to the donnable gear in its donned position. In one embodiment, the second attachment member 53 includes an open portion that is slidable through a Molle loop (as shown by the dashed portion in FIG. 1).

One major benefit to the presence of the RSM holder 14 is that the wearer can don gear such as their radio and the RSM before putting on their coat and can rotate the RSM holder 14 out of the way as shown in FIGS. 8 and 10 while putting on one sleeve of the coat and then again while putting on the other sleeve of the coat. This make for faster response times and the ability to wear the radio at all times per best practices by rescue personnel such as firefighters.

The first end 48 of the elongate body 46 further comprises a third attachment member 52 proximate the second attachment member 53, that is releasably attachable to the donnable gear or article of clothing. This third attachment member 52 is a one-way fastener positioned to disengage only when a wearer pulls upward on the elongate body 46 toward their head or shoulder when donned. In one embodiment, this is a one-way snap, but is not limited thereto. The presence of the second attachment member 53 and the third attachment member 53 at the first end 48 provides redundancy and a more secure connection during emergency response situations.

A plurality of RSM attachment member 30 is spaced apart along the length of the first major side 59. The first end 48 of the elongate body 46 is releasably attachable to a donnable article of clothing or gear as shown in FIG. 1 by the dashed portion of RSM holder 14 being inserted through a loop on the strap 10.

The RSM attachment members 30 in FIGS. 2 and 3 are a strip of Molle loops. In other embodiments, the RSM members 30 may be quick connect buckles, clips, hooks, clasps, hook-and-loop material, a plurality of tie straps or stretchable cords, clips, or any other members that facilitates anchoring the RSM to the elongate body 46. When the RSM attachment members 30 are Molle loops, the RSM holder 14 may further include one or more web dominator clips 34 each connected to a Molle loop, which are useful for securing the electrical cord extending from the RSM to the elongate body so that it stowed away and protected from snagging on objects in the surroundings.

The elongate body 46 is long enough to extend from a shoulder of a wearer when donned under an article of clothing to the exterior of the article of clothing below a collar portion thereof proximate the throat of a wearer. The elongate body 46 may include or be made of fire and abrasion resistant material. In one embodiment, the material of the elongate body 46 resists igniting, burning, melting, dripping, or separation when exposed to a temperature of 500° F. for five minutes.

In the depicted embodiment, the first end 48 includes both an attachment feature 52 which is adapted to mate with the attachment features 40 of the shoulder strap 10, as well as a G-hook 53 which facilitates securement to the shoulder strap 10 via one loop 30 of the MOLLE system proximate to the pertinent attachment feature 40, which may be along the body 24 of the shoulder strap 10 proximate to the shoulder-contact portion 44. In one embodiment, the attachment feature 52 of the remote speaker mic holder 14 and the attachment features 40 of the shoulder strap 10 are snaps, and in particular one-way snaps, but the attachment features 40, 52 may alternately be any other releasable fastening mechanism known in the art. Alternately, the end 48 of the remote speaker mic holder 14 may be permanently attached to the shoulder strap 10.

Accordingly, with reference to FIGS. 8, 10, and 12, when the end 48 of the remote speaker mic holder 14 is secured to the shoulder strap 10, and the opposite end 50 is free, the remote speaker mic holder 14 is securely attached to the wearer, yet freely mobile to extend away from the user's body as desired to provide maximum access to the microphone 23 and freedom to comfortably and conveniently position the microphone. As shown in FIG. 12, if the user is wearing turnout gear, the remote speaker mic holder 14 can extend out of the lapel to provide access to the microphone 23 without sacrificing the added support and protection of the remote speaker mic holder 14. Furthermore, the range of movement provided by the remote speaker mic holder 14 permits the user to don turnout gear and properly position the microphone 23 on the outside thereof without the added steps of removing and repositioning the entire shoulder strap 10 to the outside of the turnout gear. This also permits the turnout gear and other PPE to protect the shoulder strap 10 and its contents.

Referring again to FIGS. 1-3, the end 50 of the remote speaker mic holder 14 may include an attachment feature 54 which is adapted to mate with the attachment features 42 of the shoulder strap 10. In one embodiment, the attachment features 42, 54 are snaps, and in particular one-way snaps, but the attachment features 42, 54 may alternately be any other releasable fastening mechanism known in the art. Accordingly, when both ends 48, 50 of the remote speaker mic holder 14 are secured to the shoulder strap 10 by their respective attachment features, the remote speaker mic holder 14 is anchored in place along the body 24 of the shoulder strap 10, which minimizes the inconvenience of undesired swinging of the remote speaker mic holder 14. This configuration is advantageous for continuous donnage of the radio while in between emergencies when the turnout gear is not worn.

As shown in FIG. 1, the shoulder strap 10 may include two sets of attachment features 40, 42 (one set on each side of the body 24, respectively a left-half and a right-half relative to the orientation of FIG. 1 to the page), which ensures that the attachment features 40, 42 are available for use regardless of whether the user positions the radio mount 16 against the left hip or the right hip, thereby facilitating the reversibility of the position of the remote speaker mic holder 14 such that the entire system may be used by left-handed users as well-as right handled users. An attachment feature, such as one similar to attachment feature 42 on the strap 10, may be present on the user's gear, such as the outside of turnout gear, to facilitate securement of the end 50 of the remote speaker mic holder 14 via its attachment feature 54 to the gear.

Figure 17:
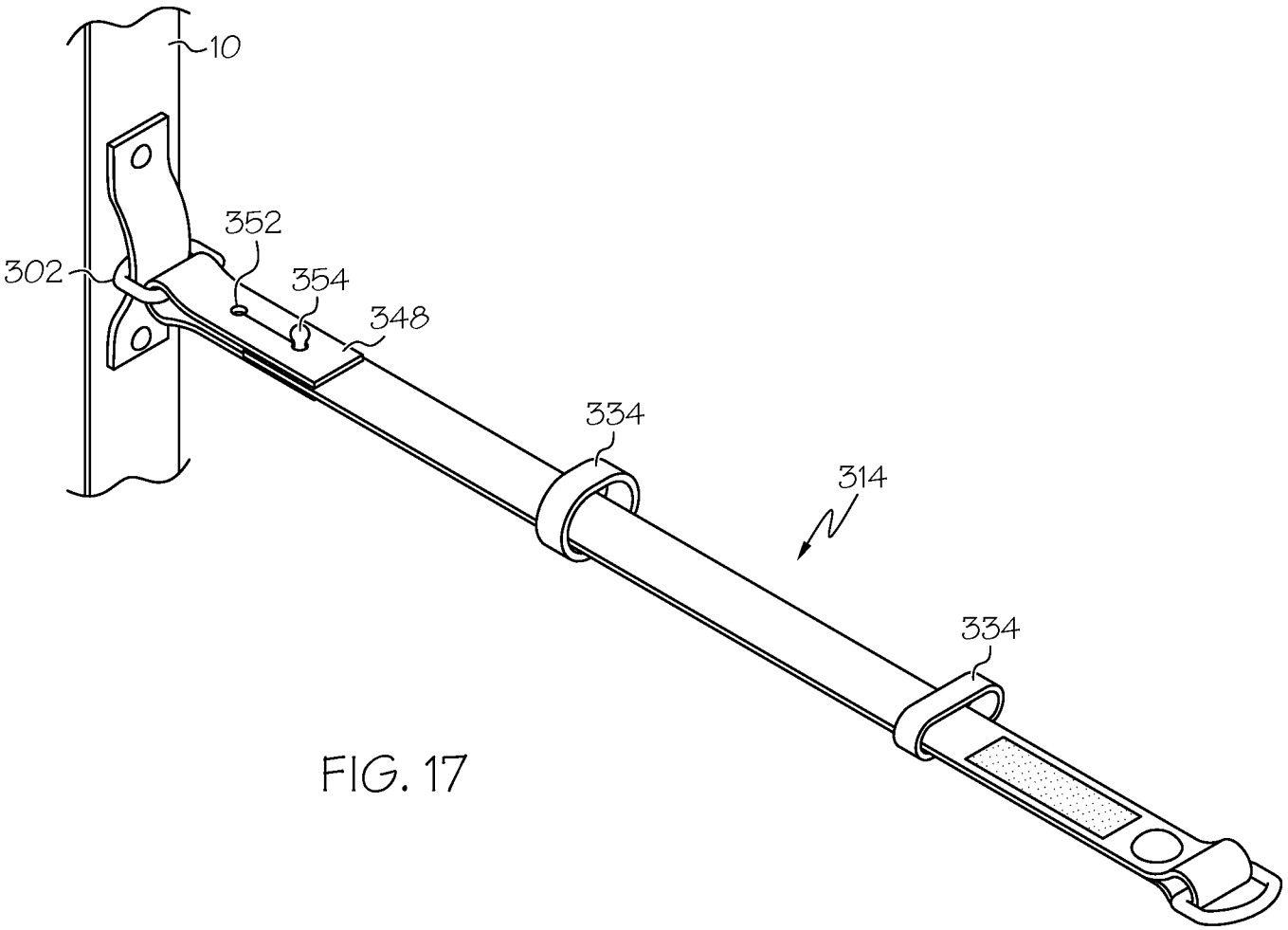
FIG. 17 is side perspective view of another embodiment of a remote speaker mic holder attachable to a radio strap.

In another embodiment, shown in FIG. 17, the shoulder strap 10 may include a loop 302 connected thereto for receiving the first end 348 of the remote speaker mic holder 314 therethrough. The first end 348 includes a first fastener 352 connectable to a second fastener 354 positioned on the remote speaker mic holder 314 a distance away from the first fastener 352. As shown in FIG. 17, the first fastener 352 is a hole and slot feature within the material of the remote speaker mic holder 314, itself, and the second fastener 354 is a post receivable in the hole and then into the slot for retention therein. In other embodiments, the first and second fasters 352, 354 may be any suitable releasably attachable fasteners including those disclosed herein, such as, but not limited to, snaps or mating hook-and-loop material. The remote speaker mic holder 314 may also include one or more mic strap retainer members 334 releasably attachable to the wire of the remote speaker mic to hold it in place against the remote speaker mic holder 314. These retainer members 334 may be fixedly or removable connected to the remote speaker mic holder 314. The remote speaker mic holder 314 may have other features that are the same or similar to those of the remote speak mic holder 14 disclosed above.

With reference to FIGS. 1, 8, and 9, the radio mount 16 and the belt attachment strap 12 connect together to provide a mechanism that reduces the load from the weight of the radio 18 from the wearer's neck and/or shoulder (i.e., along the shoulder-contact portion 44 of the radio support strap) to the wearer's waist. This permits to the wearer to bear the weight of the system more comfortably, decreasing neck, shoulder, and/or back pain associated with systems that rely heavily or entirely on the shoulder for support. The connection between the radio mount 16 and the belt attachment strap 12 also anchors the radio mount 16 to a particular location along the user's hip, preventing undesirable swaying of the radio 18 out of position during use, which eliminates the need for a separate sway strap.

The belt attachment strap 12 includes a sleeve 68 defining a channel 70 shaped and sized to receive a user's belt. Adjacent to the sleeve is a loop of material 102 defining a tube-like passage 104. A portion of a buckle **66*b* is received in the tube-like passage 104 because the loop of material 102 passes through an opening 106 through the buckle 66*b*. The belt attachment strap 12 may be formed from a single length of a material of a selected stiffness by threading a first end of the length of material through the opening 106 in the buckle 66*b*, aligning the first end with a second end of the length of material, stitching the first and second ends together, positioning the buckle equi-distant from the stitched ends, and stitching a seam 108 proximate the buckle to form the loop of material 102. While stitching is shown in this embodiment, other means of securing the material to define the loops are also included herein. As shown in FIGS. 1, and 13-15, the seam 108 defines one side of sleeve 68, which is generally perpendicular to the open ends defining channel 70**.

The buckle **66*b* of the belt attachment strap 12 is releasably mateable to the buckle 66*a* of the radio mount 16 to securely fasten the radio mount 16 to the belt attachment strap 12 and thereby to the belt 22 of the user. In one embodiment, the buckles 66*a*, 66*b* are rated to securely hold and support a load of at least 500 pounds. In one embodiment, the buckle system may be a GT Cobra® high strength polymer buckle system. In the depicted embodiment, the buckle 66*a* is a male component and the buckle 66*b* is a corresponding female component, but the relative positioning may be reversed. In one embodiment, the buckle 66***a*, 66*b* is a quick-release buckle, but the buckle 66*a*, 66*b* may alternately be replaced or supplemented with any of a variety of fasteners known in the art.

The sleeve 68 includes a channel 70 therethrough which is adapted to receive the belt 22 of the user. In one embodiment, the perimeter of the channel 70 may be fixed such that the user must slide an end of the belt 22 through a side of the sleeve 68 to attach the sleeve 68 (like a belt loop in a pair of pants). Alternately, the channel 70 may be openable and closeable to facilitate attachment of the sleeve 68 without the need for the user to unbuckle the belt 22. In one embodiment, the corners 73 of an end 71 (opposite of the end 69) of the sleeve 68 may be rounded or cut at an angle to minimize snagging on the user's clothing and/or uncomfortable poking of the user's torso.

Figure 14:
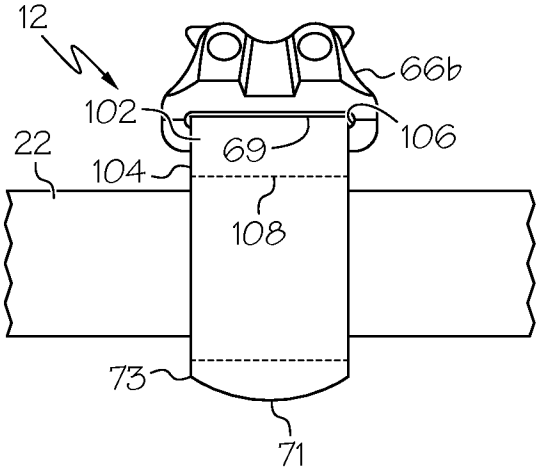
FIGS. 13-15 are plans views of alternate orientations of an embodiment of a belt attachment strap.
Figure 13:
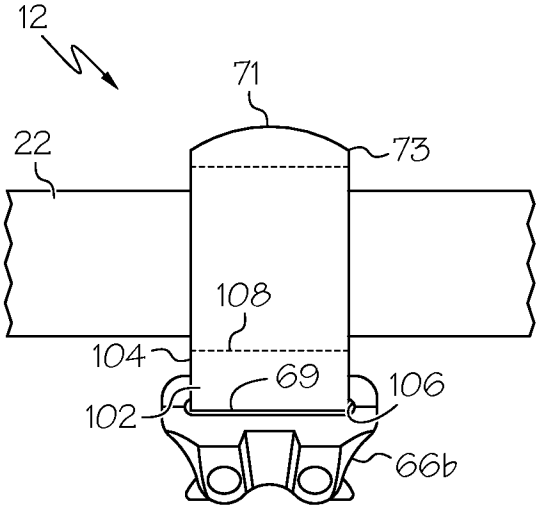
Figure 15:
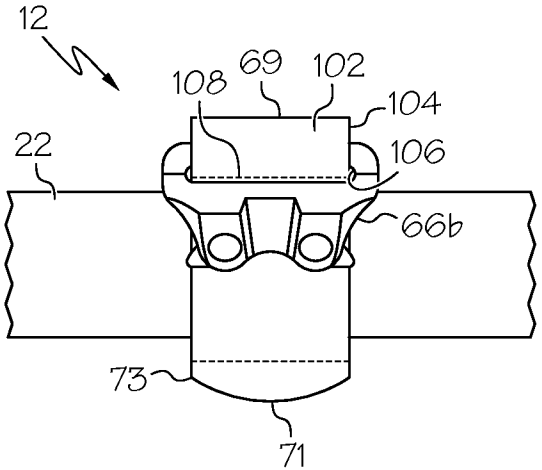

Referring additionally to FIGS. 13-15, several orientations of the belt attachment strap 12 are disclosed, each of which may be used to define the specific distance at which the radio 18 is suspended from the belt 22. Selection of an orientation depends on a variety of factors, including the desired suspension height of the radio 18 and personal comfort preferences. FIG. 13 depicts the same orientation as shown in FIG. 1. In this orientation, the end 69 of the belt attachment strap 12 is situated below the belt 22, and the buckle 66*b* is disposed at the lowest point of the belt attachment strap 12. FIG. 14, in contrast, depicts an orientation where the end 69 of the belt attachment strap 12 is situated above the belt 22, and the buckle 66*b* is oriented upwards to receive the buckle 66*a* of the radio mount 16 from the top (i.e., requiring the buckle 66*a* to be rotated downward about end 65 of the spacing extension 64, opposite of the orientation of the buckle 66*b* shown in FIG. 1). Finally, FIG. 15 depicts an orientation where the end 69 of the belt attachment strap 12 is situated above the belt 22, just as shown in FIG. 14, but the buckle 66*b* is rotated downward about end 69 to receive the buckle 66*a* of the radio mount 16 from below. FIGS. 8-10 depict a firefighter wearing the radio mount 16 in the orientation shown in FIG. 15.

Figure 4:
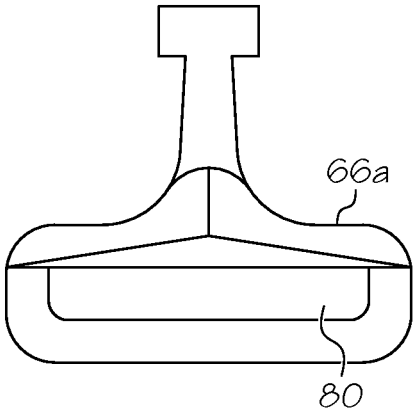
FIGS. 4 and 5 are plan views of the components of a radio mount of the wearable radio support system of FIG. 1 in a disassembled state.
Figure 5:
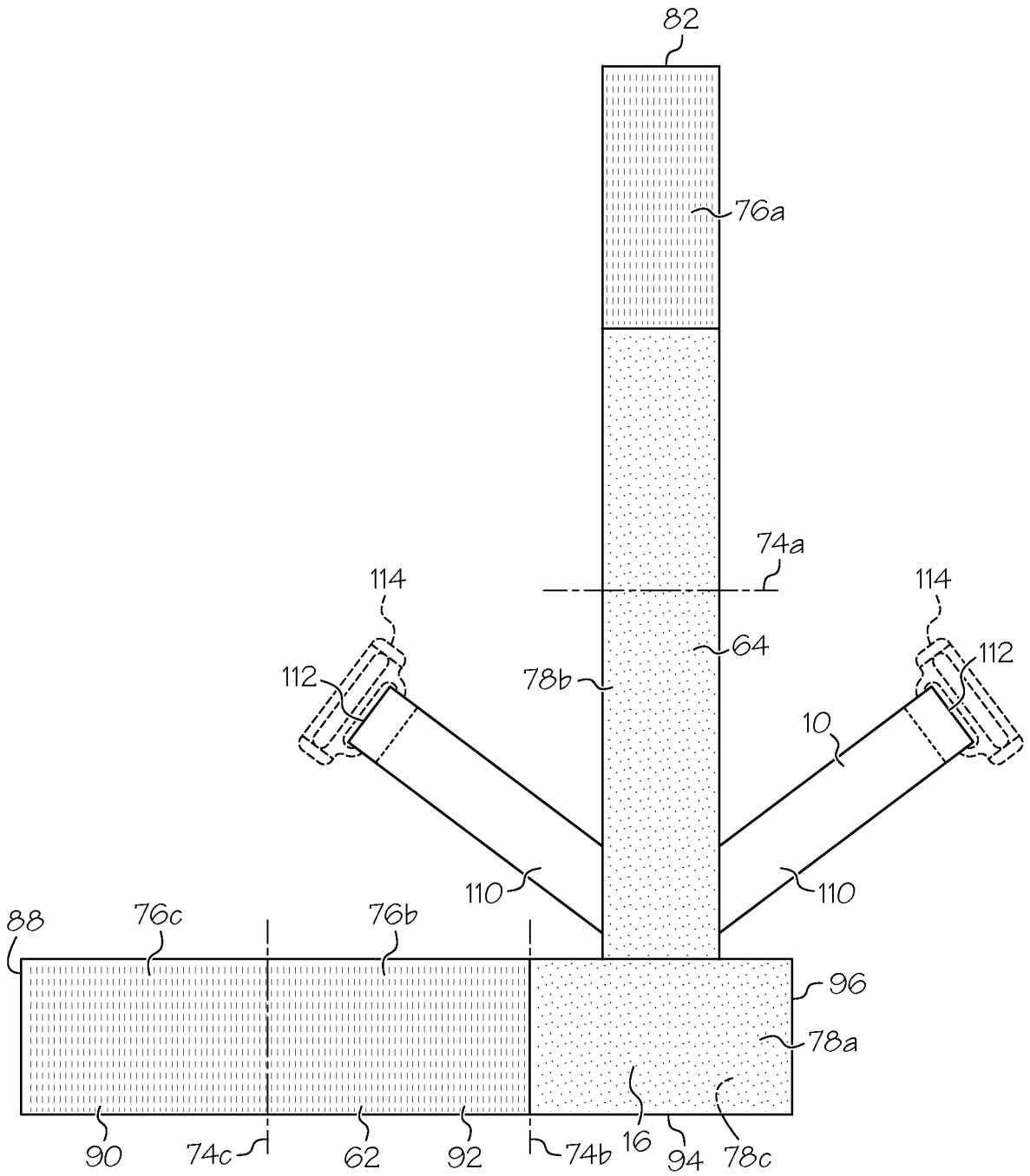

Referring now to FIGS. 4-7, an embodiment of the radio mount 16 and its method of operation to attach a radio holder 20/radio 18 is disclosed in more detail. The radio mount 16 includes an attachment scaffold 62, which is a foldable horizontal member, a spacing extension 64, which is a vertical member connected to the horizontal member proximate one end of the horizontal member, and a buckle 66*a* connected to the vertical member. FIGS. 4 and 5 show each of these components in a disassembled, unfolded state. The spacing extension 64 may be permanently attached to the attachment scaffold 62. As shown in FIG. 1, the ends 72 of the shoulder strap 10 may be permanently attached to one or both of the spacing extension 64 and the attachment scaffold 62. In another embodiment, as shown in FIG. 5 as an option, the shoulder strap 10 may be releasably coupled to the radio mount 16 such that the radio mount 16 could be attached to a generic strap such as the typical commercially available strap or to strap 10 disclosed herein. As shown in FIG. 5, the radio mount 16 may include arms 110 permanently attached to one or both of the spacing extension 64 and the attachment scaffold 62 that terminate at the distal end 112 with a fastening member 114. The fastening member 114 may be a ring as shown, connectable to a clasp or hook of a strap, or vice versa. In other embodiments, the fastening members may be quick connect buckles, the same or similar to buckles 66*a*, 66*b*, snaps, such as one-way snaps, mating hook-and-loop material, or any other fasteners that will provide adequate strength to the system to support the radio 18.

Both the spacing extension 64 and the attachment scaffold 62 may be formed of lengths of generally stiff material which are folded into the configuration shown in FIG. 1. Accordingly, both the attachment scaffold 62 and the spacing extension 64 may include hinged or foldable/bendable areas such as bendable area 74*a* of the spacing extension 64 and a first bendable area 74*b* and a second bendable area 74*c* of the attachment scaffold 62. The precise location of the foldable areas 74 need not be permanently fixed, thereby permitting adjustment of the final dimensions of the attachment scaffold 62 and the spacing extension 64. The spacing extension 64 and the attachment scaffold 62 may further include patches of hook-and-loop fastening material 76, 78, where, in the figures, patches 76 indicate one type of patch (i.e., hook or loop) and patches 78 indicate the compatible mating type. Alternately, instead of hook-and-loop fastening patches 76, 78, any of a variety of other fastening mechanisms known in the art may be used.

Figure 7:
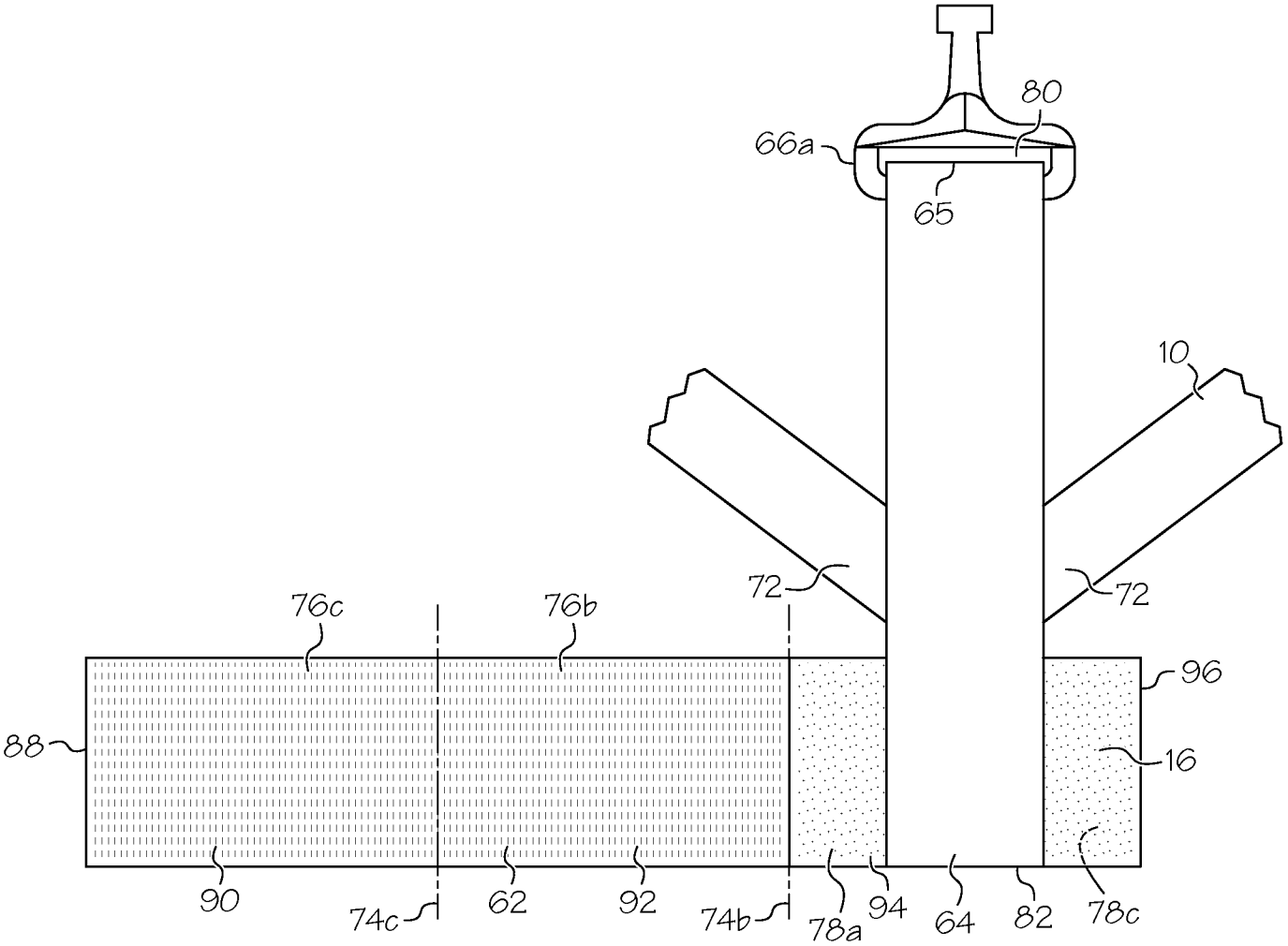
FIG. 7 is a partially-assembled plan view of the radio mount of the wearable radio support system of FIG. 1.

With reference to FIGS. 4, 5, and 7, to form the radio mount 16, the buckle 66*a*, which includes a channel 80 therethrough, is fitted over an end 82 of the spacing extension 64. The end 82, which includes fastening patch 76*a*, is then folded about the foldable area 74*a* to attach to the fastening patch 78*a* of the attachment scaffold, yielding the configuration shown in FIG. 7. Note that the end 65 (FIG. 1) of the fully-assembled spacing extension 64 generally coincides with the location of the foldable area 74*a*. To provide a fully-assembled spacing extension 64 of a different height, the fastening patch 76*a* may alternately attach to a higher or lower portion of patch 78*a*, or to a location along patch 78*b* of the spacing extension 64 itself (Note that adjusting the attachment location of the fastening patch 76*a* will necessarily impact the precise location of foldable area 74*a*.)

Figure 6:
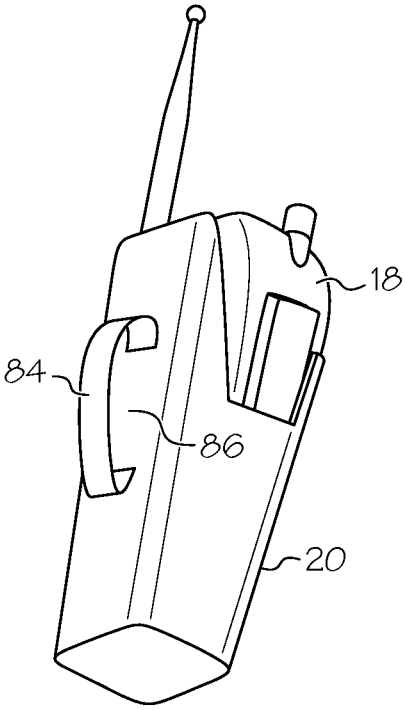
FIG. 6 is a side, plan view of a radio and radio holder for use with the wearable radio support system of FIGS. 1-5.

Referring now to FIGS. 6 and 7, the radio holder 20 may include a loop 84 defined by a belt, clip, or some other feature thereof defining a channel 86 designed to receive a user's belt or other type of strap to secure the radio holder 20 thereto. In some cases, the radio 18 itself may include a belt loop or clip for the same purpose, and the disclosures herein with respect to the radio holder 20 apply equally to a radio 18 so equipped. The attachment scaffold 62 is adapted to receive and retain the radio holder 20 via the belt loop 84.

In the unfolded view of FIGS. 5 and 7, the attachment scaffold 62 has three segments 90, 92, and 94, as defined by the foldable areas 74*b* and 74*c*. To mount the radio holder 20 to the attachment scaffold 62, the loop 84 is fitted over an end 88 of the attachment scaffold 62 such that the end 88 is received in the channel 86 of the loop 84. The radio holder 20 is guided along the length of the attachment scaffold 62 until it is positioned within segment 92 of the attachment scaffold 62, between foldable areas 74*b* and 74*c*. Segments 90 and 92 of the attachment scaffold 62 are then folded about foldable area 74*b*, which mates fastening patches 76*b* with patch 78*a* (note that, as shown in FIG. 7 and earlier discussed, a portion of fastening patch 78*a* may already be utilized by the fastening patch 76*a* of the spacing extension 64). Accordingly, the belt loop 84 of the radio holder 20 is sandwiched between segments 92 and 94 of the attachment scaffold 62. Next, segment 90 of the attachment scaffold 62 is also folded about foldable area 74*c*, to rotate segment 90 entirely around an end 96 of the attachment scaffold 62 to facilitate attachment of fastening patch 76*c* with the corresponding fastening patch 78*c* on the underside of segment 94. Accordingly, the radio holder 20 is firmly secured to the attachment scaffold 62 in the configuration depicted in FIG. 1.

Like the body 24 of the shoulder strap 10 and the elongate body 46 of the remote speaker mic holder 14, the attachment scaffold 62 and spacing extension 64 of the radio mount 16 and the sleeve 68 of the belt attachment strap 12 may be formed of any of a variety of materials, including but not limited to military-grade, nylon webbing, such as SCBA webbing. The attachment scaffold 62, the spacing extension 64, and the belt anchor 68 portions are made of a stiffer material compared to the material used for the shoulder strap 10. The stiffer material provides the necessary support for the weight of the radio 18 without allowing the radio to swing or sway freely as a result of the material itself. The material while being stiffer is still bendable and/or foldable. For example, the stiffer material may be thicker and/or more densely-woven webbing than the material used for the shoulder strap 10. In one embodiment, the stiffer material may be a thicker and/or more densely woven nylon webbing, for example nylon scuba webbing.

Though the disclosures herein are described in the context of a radio support system, those skilled in the art will appreciate the applicability of the principles and concepts disclosed in the context of any shoulder strap-based device, including but not limited to firearm holsters, messenger bags, computer cases, and the like.

Figure 16:
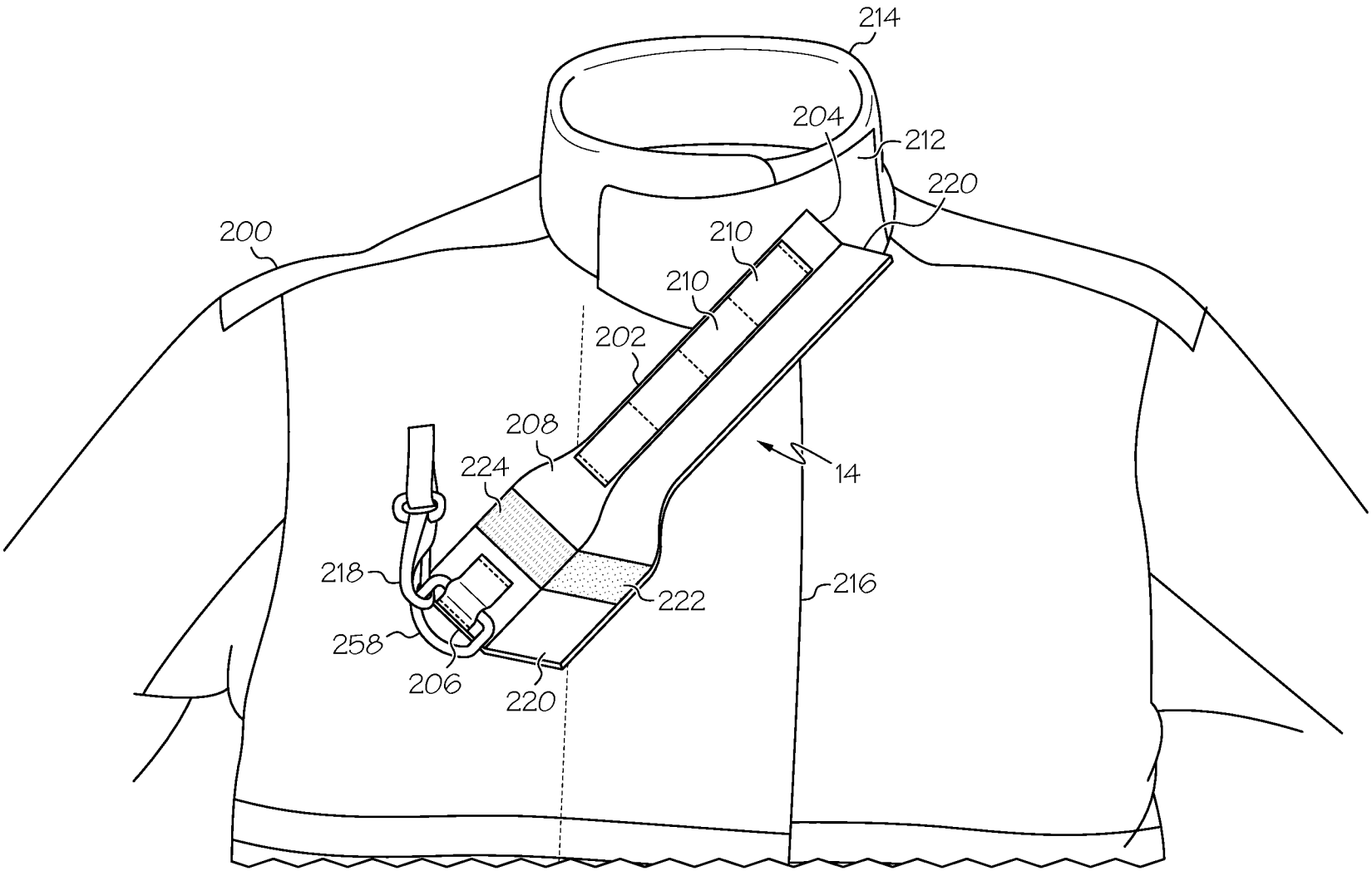
FIG. 16 is a front view of a turnout coat having an embodiment of a remote speaker mic holder permanently attached thereto.

Referring now to FIG. 16, in an alternate embodiment the remote speaker mic holder 14 is permanently attached to an article of clothing, for example a firefighter turnout coat 200. The remote speaker mic holder 14 has an elongate body 202 having a first end 204 and a second end 206 and a first major side 208 extending from the first end to the second end. A plurality of RSM attachment members 210 are spaced apart along the length of the first major side 208. The first end 204 of the elongate body 204 is permanently attached to the article of clothing proximate a throat-covering portion 212 thereof, which is illustrated as a throat tab in FIG. 16, but alternately could be the left portion or the right portion of the collar 214 of the coat 200, or could be an extension of the flap 216 that covers the fasteners of the main body of the coat 200. The elongate body 204 is generally positioned to the left of the sagittal plane of the article of clothing 200 or generally to the right of the sagittal plane of the article of clothing 200. At or proximate the second end 206 of the elongate body 202 is at least one first attachment member 258 that is connectable to a feature 218 of the article of clothing 200.

The junction of the first end 204 of the elongate body 202 to the article of clothing 200 is flexible such that the elongate body 202 is movable to one or more selected positions to dispose the first attachment member 258 for connection to the article of clothing. In one embodiment, the first attachment member 258 is a one-way fastener (not shown in FIG. 16) that disengages only when a wearer pulls upward on the elongate body generally toward their head or one of their shoulders when donned. For example, the one-way fastener may be a one-way snap, but is not limited thereto. In other embodiments, the first attachment member 258 may be a hook, clasp, hook-and-loop material, a tie strap, a stretchable cord, a clip, a button, a magnet, a buckle, ring, or any other member that facilitates anchoring the second end 206 in a desired position to locate the RSM proximate the mouth of the wearer.

A shown in FIG. 16, the RSM attachment members 210 are a strip of Molle loops. In other embodiments, the RSM members 210 may be quick connect buckles, clips, hooks, clasps, hook-and-loop material, a plurality of tie straps or stretchable cords, clips, or any other members that facilitates anchoring the RSM to the elongate body 202. When the RSM attachment members 210 are Molle loops, the RSM holder 14 may further include one or more web dominator clips each connected to a Molle loop. The elastic members of the web dominator clips 34 in FIG. 3 are useful for securing the electrical cord extending from the RSM to the elongate body so that it stowed away and protected from snagging on objects in the surroundings.

As shown in FIG. 16, the RSM holder 14 may include a flap 220, which may be fire and abrasion resistant material, extending from one elongate edge of the first major side 208. The flap 220 is foldable over the elongate body 202 and is releasably attachable thereto, for example by mating hook-and-loop material 222, 224, but is not limited thereto. Any of the various types of fasteners or attachment members described herein above may be possible here as well. While the embodiment in FIGS. 2 and 3 does not show a flap like flap 220, it may also include such a flap to protect the cord of the RSM.

All or part of the components disclosed herein for the RSM holder, the radio support, and the shoulder strap may be made of or include a variety of materials, including a flame, heat and abrasion resistant material such as a compact weave of aramid fibers and/or polybenzamidazole fibers. Commercially available aramid materials include NOMEX and KEVLAR fibers (both trademarks of E.I. DuPont de Nemours and Company, Inc. of Wilmington, Del.), and commercially available polybenzamidazole fibers include PBI fibers (a trademark of PBI Performance Fabrics of Charlotte, N.C.). Thus, the components disclosed herein may be an aramid material, a blend of aramid materials, a polybenzamidazole material, a blend of aramid and polybenzamidazole materials, or other appropriate materials. If desired, the components may have portions thereof coated with a polymer or coated with a durable, water repellent finish (i.e. a perfluorohydrocarbon finish, such as TEFLON® finish sold by E. I. Du Pont de Nemours and Company, Inc. of Wilmington, Del.).

Each of these materials, and the components disclosed herein as a whole, may meet the National Fire Protection Association ("N.F.P.A.") 1971 standards for protective firefighting garments ("Protective Clothing for Structural Firefighting"), which are entirely incorporated by reference herein. The NFPA standards specify various minimum requirements for heat and flame resistance and tear strength. For example, in order to meet the NFPA standards, the components must be able to resist igniting, burning, melting, dripping and/or separation at a temperature of 500° F. for at least five minutes.

Although various aspects of the disclosed wearable radio support system have been shown and described, modifications may become apparent to those skilled in the art upon reading the specification. The present application includes such modifications and is limited only by the scope of the claims.

What is claimed is:

1. A wearable radio support system comprising:

a shoulder strap connectable to a radio holder, wherein the shoulder strap has, proximate a shoulder-contact portion thereof, a first set of attachment features on a first half of the shoulder-contact portion juxtaposed to a second set of attachment features on a second half of the shoulder-contact portion;

an elongate strap having a first end comprising a first fastener and a second fastener releasably attachable to either of the first set or the second set of attachment features of the shoulder strap and having an opposing free end;

wherein the first fastener of the first end of the elongate strap has a first feature that is slidable through a loop of either of the first set or the second set of attachment features and provides a point of rotation for the elongate strap relative to the shoulder strap and the second fastener of the first end of the elongate strap connects to a second feature of the same set of attachment features to anchor the elongate strap to the shoulder strap, which no longer allows the first end of the elongate strap to rotate about the first feature.

2. The system of claim 1, wherein the opposing free end of the elongate strap has a third releasably attachable fastener connectable to a feature of a donnable turnout coat.

3. The system of claim 1, wherein the elongate strap is made of fire and abrasion resistant material and/or comprises a flap or sleeve of fire and abrasion resistant material that protects the elongate strap from the environment.

4. The system of claim 1, wherein each of the first set and second set of attachment features comprise a Molle loop and one-half of a one-way snap.

5. The system of claim 4, wherein the first fastener of the first end of the elongate strap is a hook and the second fastener of the first end of the elongate strap is a second-half of a one-way snap.

6. The system of claim 1, wherein a first end and a second end of the shoulder strap include a releasably attachable fastener.

7. The system of claim 6, wherein the releasably attachable fastener is selected from the group consisting of buckles, clips, snaps, and hook-and-loop fasteners.

8. The system of claim 1, wherein the shoulder strap is made of nylon webbing, fire and abrasion resistant material, or leather.

9. The system of claim 1, wherein the shoulder strap includes a Molle system and a cord retention clip comprising an anchor and an elastic loop connectable to the anchor.

10. The system of claim 1, wherein the shoulder strap has an adjustable length.

11. The system of claim 1, wherein the elongate strap has an adjustable length.

12. The system of claim 1, wherein the elongate strap includes a Molle system and a cord retention clip comprising an anchor and an elastic loop connectable to the anchor.

13. The system of claim 1, wherein the elongate strap includes a remote speaker microphone attachment member selected from the group consisting of buckles, clips, hooks, clasps, hook-and-loop material, tie straps, stretchable cords, and combinations thereof.

14. The system of claim 1, wherein the elongate strap extends from a shoulder of a wearer when donned to the exterior of an article of clothing below a collar of the clothing to position a remote speaker microphone proximate a throat of the wearer.

15. A wearable radio support system comprising:

a shoulder strap connectable to a radio holder, wherein the shoulder strap has, proximate a shoulder-contact portion thereof, a first set of attachment features on a first half of the shoulder-contact portion and a second set of attachment features on a second half of the shoulder-contact portion;

an elongate strap having a first end comprising a first fastener and a second fastener releasably attachable to either of the first set or the second set of attachment features of the shoulder strap and having an opposing free end;

wherein the first fastener of the first end of the elongate strap connects to a first feature of either of the first set or the second set of attachment features and provides a point of rotation for the elongate strap relative to the shoulder strap and the second fastener of the first end of the elongate strap connects to a second feature of the same set of attachment features to anchor the elongate strap to the shoulder strap, which no longer allows the first end of the elongate strap to rotate about the first feature;

wherein each of the first set and second set of attachment features comprise a Molle loop and one-half of a one-way snap.

16. The system of claim 15, wherein the first fastener of the first end of the elongate strap is a hook and the second fastener of the first end of the elongate strap is a second-half of a one-way snap.

* * * * *